US005367829A

United States Patent [19]

Crossley et al.

[11] Patent Number: 5,367,829

[45] Date of Patent: Nov. 29, 1994

[54] SECURITY GATE

[75] Inventors: David W. Crossley, Woonsocket, R.I.; Keith R. Wruck, Assonet; Randy L. Abrams, Leominster, both of Mass.

[73] Assignee: Safety 1st, Inc., Chestnut Hill, Mass.

[21] Appl. No.: 81,613

[22] Filed: Jun. 23, 1993

[51] Int. Cl.[5] ..... E05C 21/02; E06B 3/68

[52] U.S. Cl. ..... 49/465; 49/55; 49/57

[58] Field of Search ..... 49/463, 464, 465, 466, 49/50, 55, 57; 160/222, 224, 225, 223

[56] References Cited

U.S. PATENT DOCUMENTS

| | | | |
|---|---|---|---|
| 367,162 | 7/1887 | Peterson . | |
| 498,574 | 5/1893 | Ryan . | |
| 604,411 | 5/1898 | Motley . | |
| 865,404 | 9/1907 | Laurent . | |
| 905,142 | 12/1908 | Bond . | |
| 1,238,294 | 8/1917 | Hertz . | |
| 1,465,443 | 8/1923 | Josler . | |
| 1,515,454 | 11/1924 | Wilson . | |
| 1,849,024 | 3/1932 | McKee . | |
| 2,199,851 | 5/1940 | Culver . | |
| 2,295,194 | 9/1942 | Atkinson . | |
| 2,511,372 | 6/1950 | Price . | |
| 2,581,857 | 1/1952 | Harrison . | |
| 2,756,469 | 7/1956 | Cattermole et al. . | |
| 2,803,471 | 8/1957 | Roth . | |
| 2,896,277 | 7/1959 | Halligan . | |
| 2,928,146 | 3/1960 | Kuniholm . | |
| 2,982,353 | 5/1961 | Luger . | |
| 3,000,063 | 9/1961 | Hoog . | |
| 3,120,032 | 2/1964 | Burnette . | |
| 3,163,205 | 12/1964 | Gotlieb . | |
| 3,216,482 | 11/1965 | Lindholm . | |
| 3,348,561 | 10/1967 | Mutch . | |
| 3,431,966 | 3/1969 | Injeski . | |
| 3,489,201 | 1/1970 | Curry, II et al. . | |
| 3,680,260 | 8/1972 | Bauer . | |
| 3,885,616 | 5/1975 | Berkowitz . | |
| 3,942,576 | 3/1976 | Rickard . | |
| 4,004,325 | 1/1977 | Hubachek . | |
| 4,367,819 | 1/1983 | Lewis . | |
| 4,437,265 | 3/1984 | Turro et al. . | |
| 4,470,277 | 9/1984 | Uyeda . | |
| 4,607,455 | 8/1986 | Bluem et al. . | |
| 4,677,791 | 7/1987 | Larsen et al. . | |
| 4,702,036 | 10/1987 | Johnson | 49/57 X |
| 4,777,765 | 10/1988 | Johnson, Jr. | 49/57 X |
| 4,944,117 | 7/1990 | Gebhard et al. . | |
| 5,052,461 | 10/1991 | Stern | 160/224 |
| 5,134,806 | 8/1992 | Burkart, Jr. | 49/55 X |
| 5,272,840 | 12/1993 | Knoedler et al. | 49/463 |

FOREIGN PATENT DOCUMENTS

| | | |
|---|---|---|
| 212089 | 5/1957 | Australia . |

OTHER PUBLICATIONS

Photocopy of Gerry Walk-Thru Gate packaging (2 sheets).

Promotional Brochure Entitled "Gerry Security Gates".

*Primary Examiner*—Philip C. Kannan

*Attorney, Agent, or Firm*—Wolf, Greenfield & Sacks

[57] ABSTRACT

A security gate for children having a pair of gate sections that slide relative to each other to vary the effective width of the gate. The sections carry bumpers on their outer vertical side rails, and the bumpers on one side rail are extendable so that they force the bumpers to frictionally engage the sides of an opening to be closed by the gate. Independent of the bumpers brackets are provided on the vertical outer side rails and the sides of the opening to position the gate in the opening and resist the gate from being pushed out of the opening. The gate may be permanently mounted in the opening by hinges or may be removable from the opening.

17 Claims, 12 Drawing Sheets

SECURITY GATE

BACKGROUND OF THE INVENTION

This invention relates to security gates for small children and is intended for use in passageways such as are found at the bottom or top of stairs, in doorways separating rooms on the same floor, and passages through iron railings.

A variety of gates are presently on the market that are designed to prevent children from passing from one area to another or from ascending or descending stairs. The principle object of the present invention is to provide a very convenient and easy to use gate for that purpose that complies with all of the standards imposed by consumer groups and government agencies.

Another object of the present invention is to provide a child's security gate that may be easily positioned in a passageway and subsequently locked in place.

Another object of the present invention is to provide a child's security gate that may either be permanently or removably installed in a passageway.

A number of patents are found in the prior art which disclose a variety of different gates. The present invention is deemed to be an improvement over all of them in that it is easy to use, essentially child proof, relatively inexpensive, and very attractive.

In accordance with the present invention, the security gate includes a pair of gate sections that slide relative to one another when fasteners which join them together are loosened so that the effective gate width may be obtained. Once the desired effective width of the gate is established for a specific site, the width of the gate need not again be changed either for mounting or dismounting the gate at the site, but rather the gate is simply placed in position and a convenient handle on the top of the gate is pivoted to either lock or unlock the gate. The locking action in accordance with the present invention is achieved by a pair of extendable bumpers on one side of the gate, which are controlled by the handle. To secure the gate in place, the bumpers are extended by the handle, and to remove or open the gate, the bumpers are retracted.

In accordance with another aspect of the present invention, a mounting bracket assembly is provided to complement the holding forces of the bumpers when the gate is to be repeatedly mounted in and removed from a particular doorway site. The bracket assembly is independent of the bumpers and includes brackets that are integrally formed as a part of the gate sections and separate cooperating brackets that may be mounted on the sides of the passageway. This bracket assembly serves to orient the gate in the proper position before the extendable bumpers are rendered operative by the handle. In accordance with another embodiment of the present invention, the gate may be permanently installed in an opening by means of a hinge on one side so that the gate may swing into and out of the passageway to close and open it. A bracket is provided on the side of the passageway opposite the hinge, which will complement the holding action of the bumpers when the bumpers are extended and also properly position the gate to insure that the bumpers work effectively.

The invention will be better understood and appreciated from the following detailed description of several embodiments thereof selected for purposes of illustration and shown in the accompanying drawings.

DESCRIPTION OF THE PREFERRED EMBODIMENT

Figure 1:
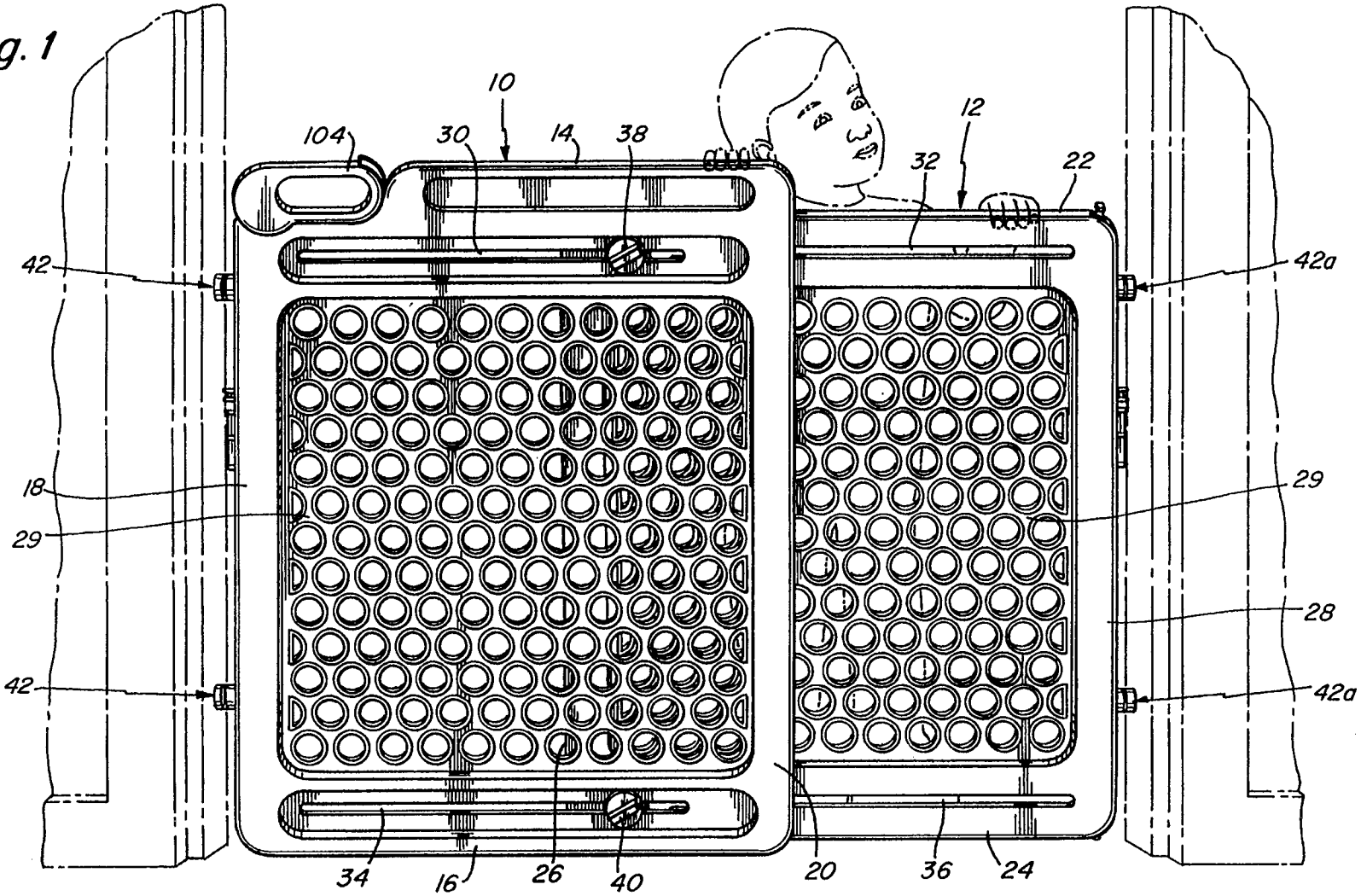
FIG. 1 is a perspective view showing a gate mounted in a doorway and constructed in accordance with the present invention.
Figure 2:
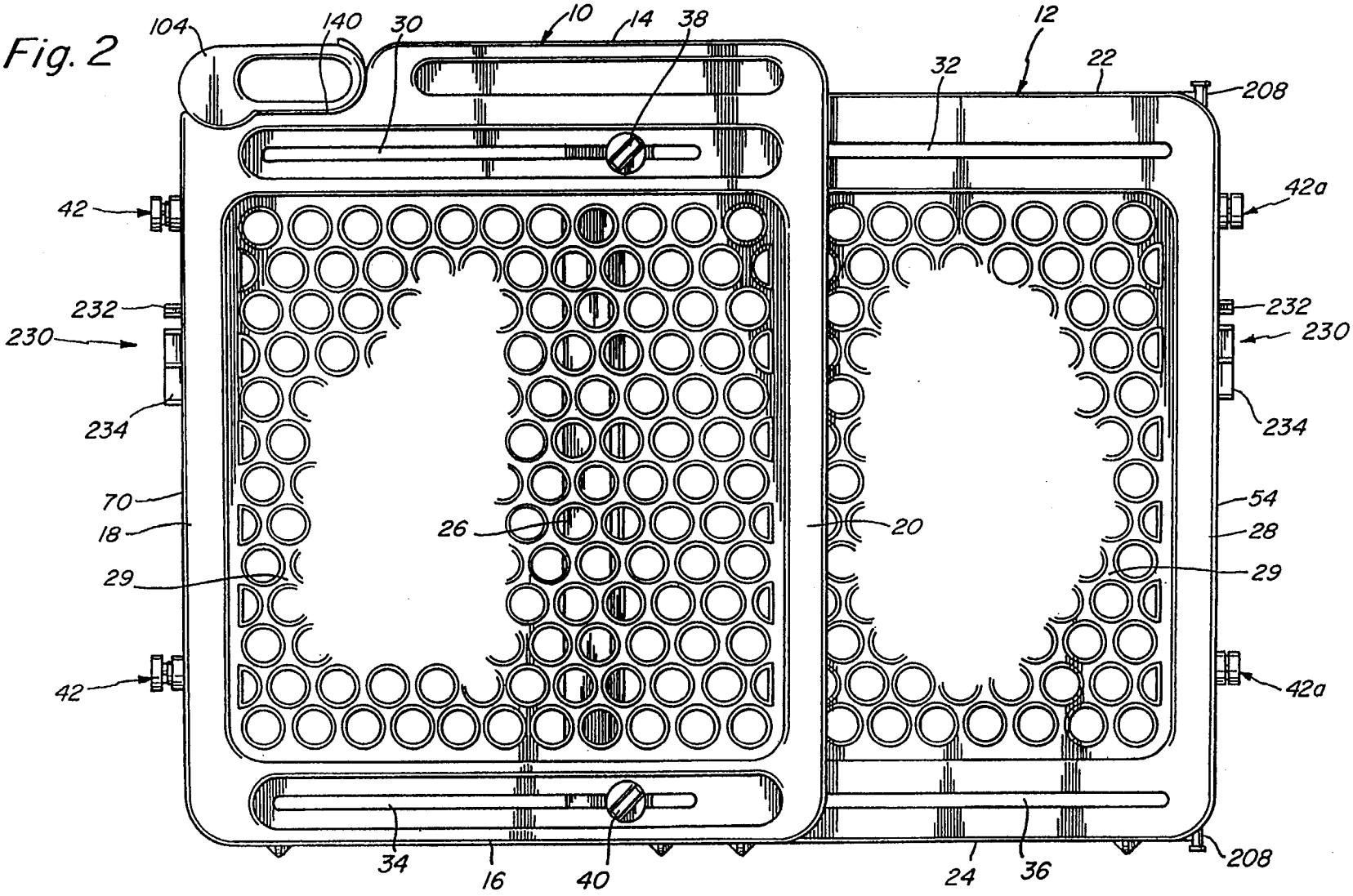
FIG. 2 is a front elevation view of the gate shown in FIG. 1.

The security gate of the present invention is made up of two major gate sections 10 and 12 which are slidable with respect to one another to vary the overall width dimension of the gate to accommodate the particular opening to be closed by it. Gate section 10 has top and bottom rails 14 and 16 and vertical side rails 18 and 20, and section 12 has top and bottom rails 22 and 24 and vertical side rails 26 and 28. In this description, the vertical rails 18 and 28 in gate sections 10 and 12 respectively are sometimes called the outer side rails. The outer side rails 18 and 28 carry bumpers 42 that are described in detail below. The area of each gate section within the rails is closed by a mesh screen 29 molded integrally with the rails and made of a matrix of round holes joined by a webbing, which prevents passage through the gate sections.

Aligned slots 30 and 32 in the upper horizontal rails 14 and 22 and similar align slots 34 and 36 in the lower horizontal rails 16 and 24 cooperate with thumbscrews 38 and 40 and their respective nuts 39 and 41 (see FIGS. 3 and 11) to enable a user to adjust the total width of the gate and tighten the sections with respect to one another in any selected effective width limited only by the sizes of the sections and the length of the slots. The rear face of the upper rail 14 of the gate section 10 has serrations 31 that bear against the front face of rail 22 when the two sections are squeezed together by the nuts and thumbscrews to more firmly hold them in the selected relationship.

An additional connection between the two gate sections 10 and 12 is made by protrusions 43 carried on the rear faces of the rails 14 and 16 of section 10 adjacent the vertical side rail 20 and the slots 32 and 36 in the upper and lower rails 22 and 24 of section 12. The protrusions 43 extend into slots 32 and 36 and have heads 45 whose diameters are greater than the width of the slots and therefore can not pull from the slots as the gate is extended. To facilitate assembly of the two gate sections, an enlargement 47 is provided in the right end of each of the slots 32 and 36 as viewed from the rear in FIG. 3 so that the heads of the protrusions may be inserted into the slots.

Figure 3:
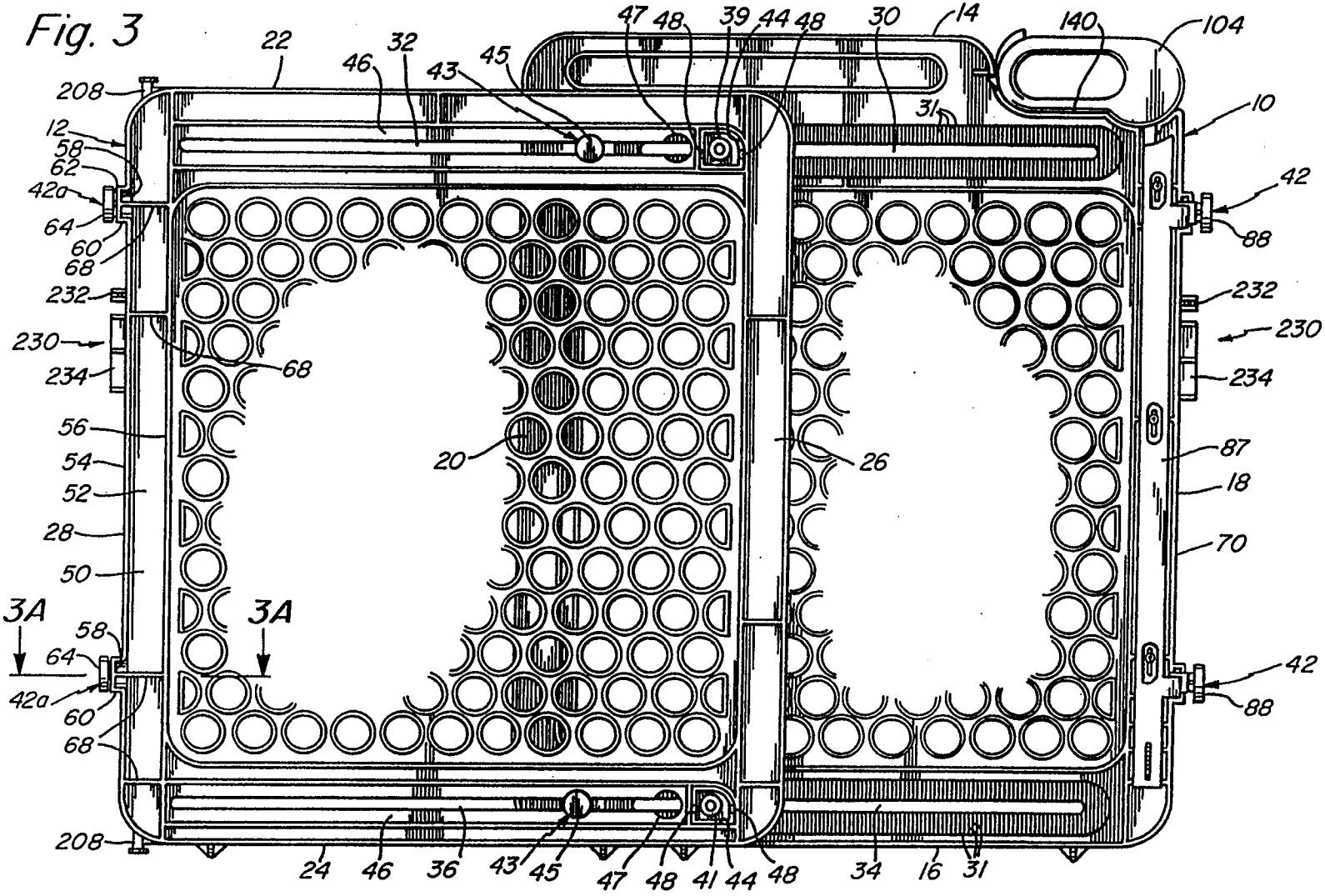
FIG. 3 is a rear elevation view thereof.
Figure 11:
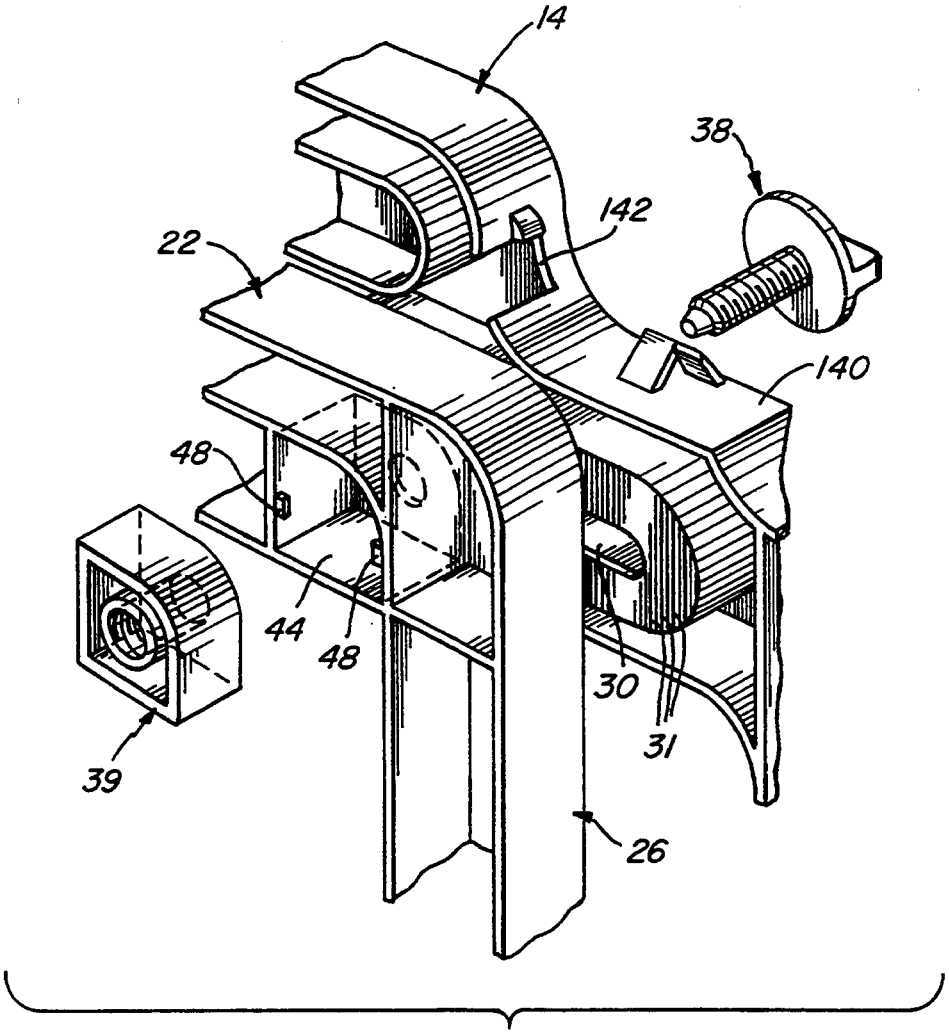
FIG. 11 is an exploded fragmentary perspective view of the adjusting mechanism in the gate that holds the two gate sections together.

It will be noted in FIGS. 3 and 11 that the nut-like members 39 and 41 that engage the thumbscrews 38 and 40 for locking the two gate sections 10 and 12 in fixed relationship to one another are each captured in a seat 44 formed in the rear channel 46 of each of the top and bottom rails 22 and 24 of the gate section 12. When the thumbscrews are loosened to permit adjustment of the effective width of the gate and the sections are moved with respect to one another, the thumbscrews 38 and 40 and their respective nuts 39 and 41 remain fixed with respect to the gate section 12 and slide in the slots 30 and 34 in the gate section 10. Similarly, the protrusions 43 remain fixed with respect to the gate section 10 and move in the slots 32 and 36 in the gate section 12. To prevent the nut-like parts 39 and 41 of the fasteners from becoming lost, small flanges 48 are provided in the walls of the seats in which the nuts are positioned so as to retain them in place.

Figure 3A:
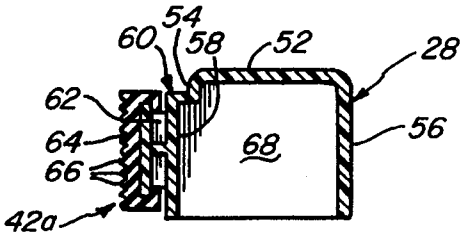
FIG. 3A is a fragmentary cross-sectional view taken along section line 3A—3A in FIG. 3.
Figure 4:
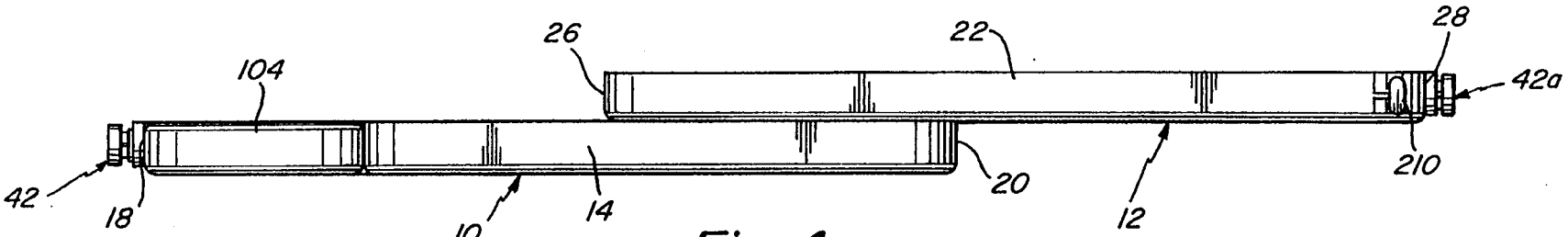
FIGS. 4 and 5 are top and bottom views, respectively, of the gate shown in FIGS. 1–3.
Figure 5:
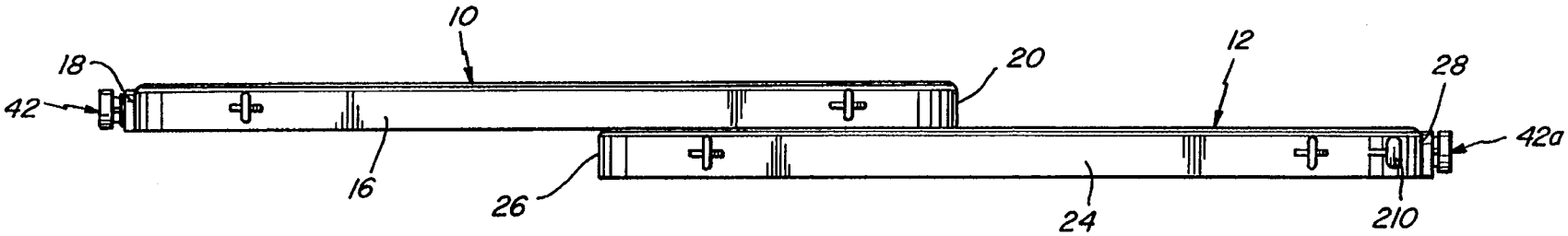
Figure 6:
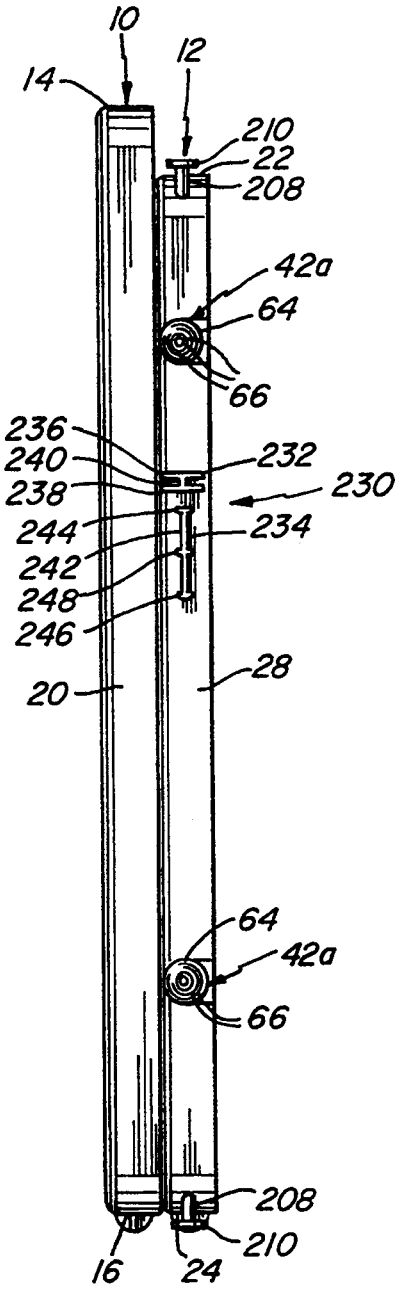
FIGS. 6 and 7 are left and right side elevation views of the gate shown in FIGS. 1–5.
Figure 7:
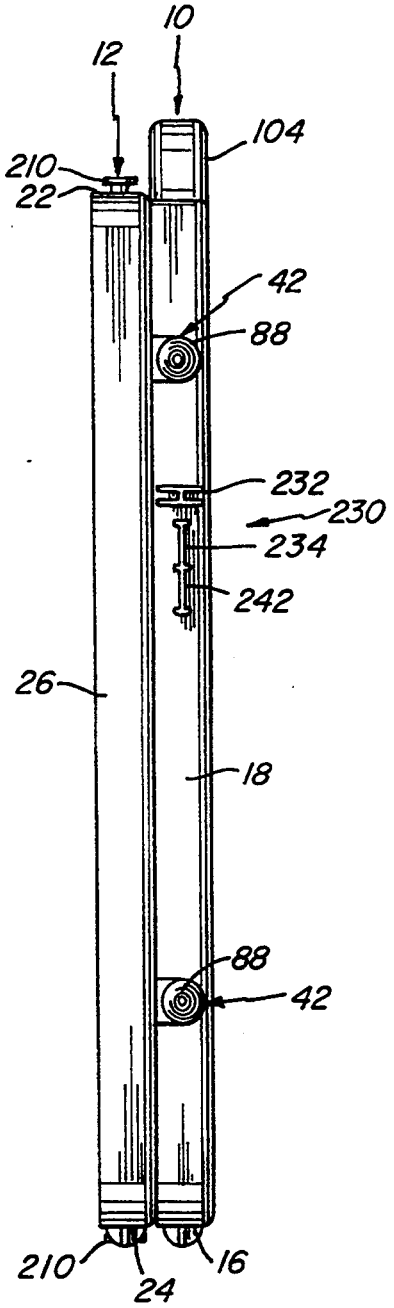

In FIGS. 1–3 and 8–10, the bumpers 42 and **42*a* carried on the outer side rails 18 and 28, respectively of the gate are shown in detail. The bumper structures 42 on rail 18 are identical to one another as are the bumpers 42*a* on rail 28. The bumpers 42*a* are fixed on rail 28 while the bumpers 42 on rail 18 can be extended or retracted to lock the gate within a door frame or other opening. As shown in FIGS. 3 and 3A, the outer side rail 28 is generally U-shaped in cross-section so as to define a channel 50 which is open on the rear side of the gate. The rail is composed of a front wall 52, outside wall 54, and inside wall 56. Platforms 60 are provided on the outside wall 54 each having a support 58 that is approximately a quarter inch above the surface of the outside wall 54. Each support 58 in turn carries a bumper mount 62 on which a rubber-like, pliable bumper cap 64 is mounted. The bumper cap 64 is stretched over the mount 62 and has an outer surface of concentric ribs 66 (see FIG. 6) which will frictionally engage the wall against which the bumper is pressed without marring the wall surface. The stiffness of the rail 28 is increased by braces 68 that join the outside and inside walls 54 and 56 as well as the front wall 52. It will be noted in FIG. 3 that some of the braces 68 are disposed in the channel 50 at the locations of the platforms 60 for the bumpers so as to resist collapse of the rail 28 when pressure is applied to the bumpers 42*a***.

Figure 8:
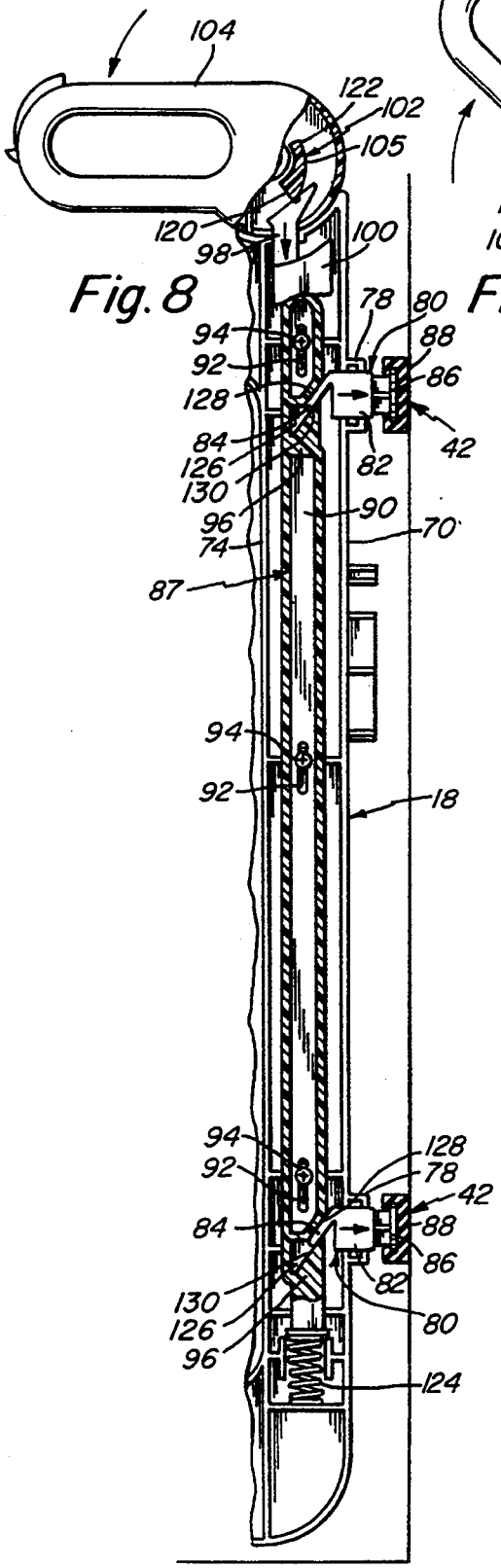
FIGS. 8 and 9 are fragmentary cross-sectional views of the side of the gate carrying the movable bumpers and respectively showing the bumpers in their extended and retracted positions.
Figure 9:
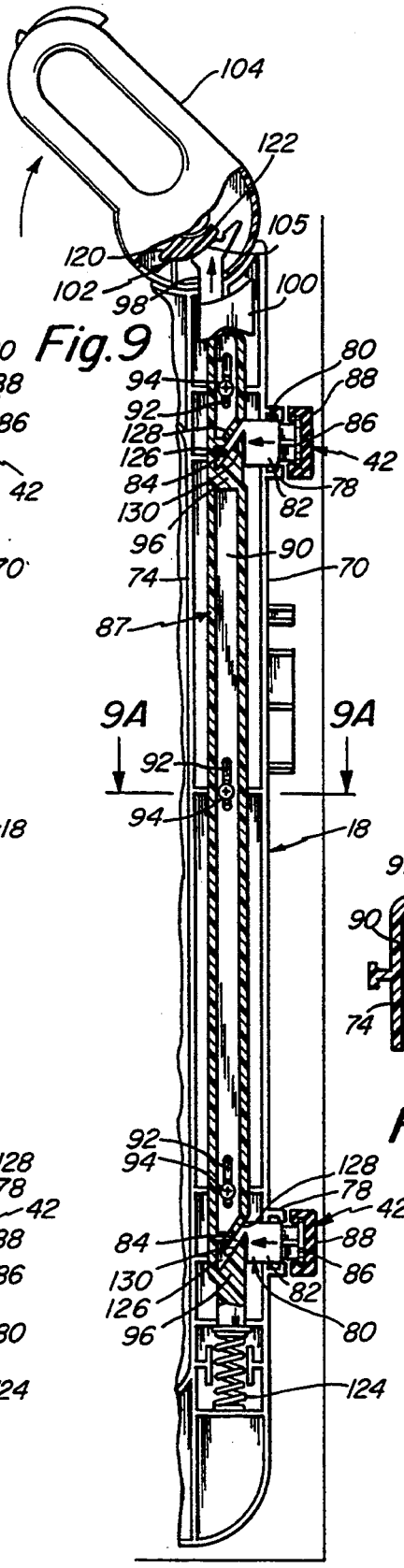
Figure 9A:
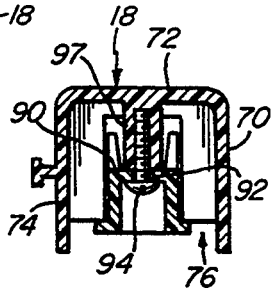
FIG. 9A is a fragmentary cross-sectional view taken along section line 9A—9A in FIG. 9.
Figure 10:
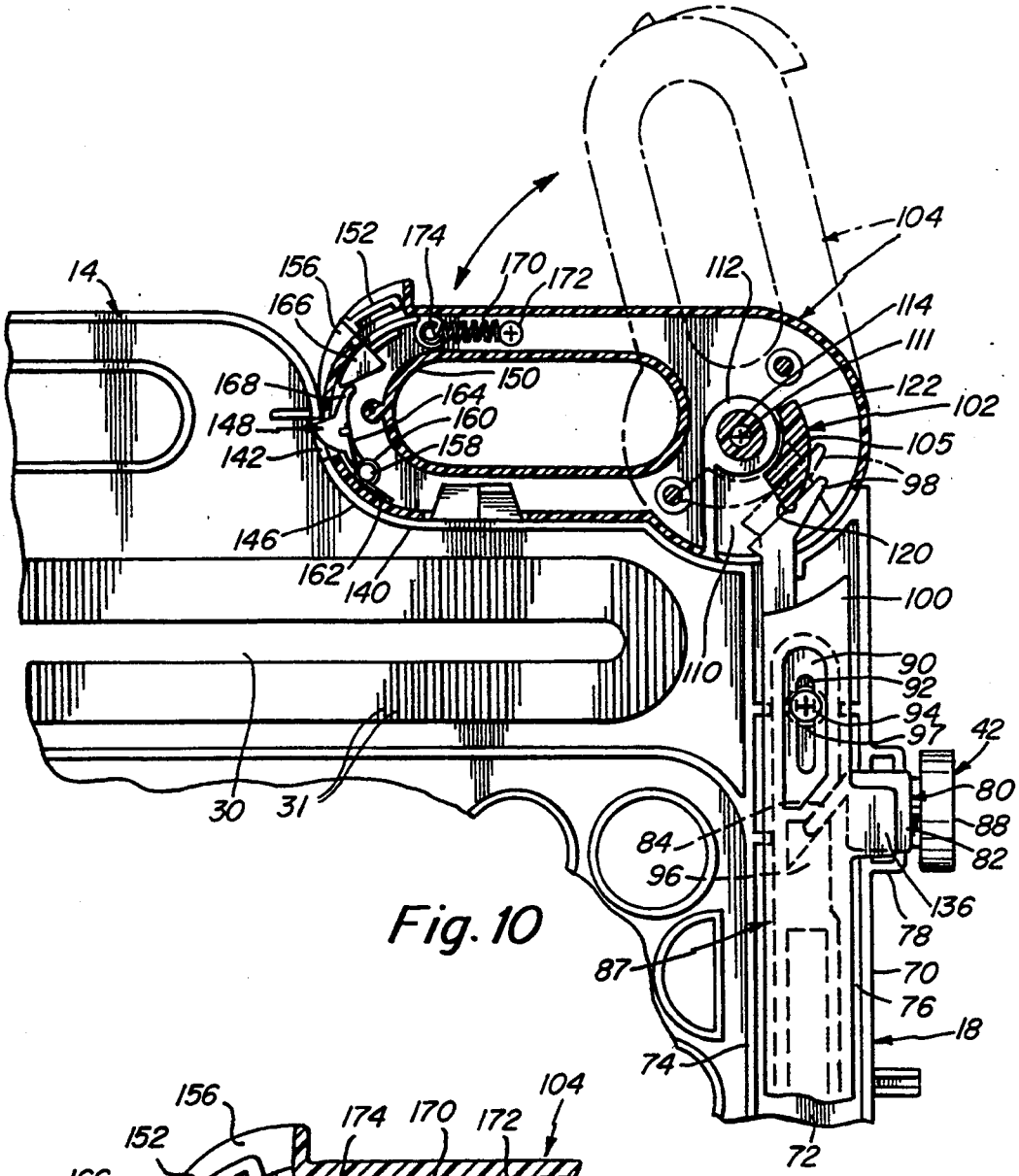
FIG. 10 is an enlarged fragmentary cross-sectional view of a portion of the actuating assembly for the extendable bumpers shown in FIGS. 8 and 9.

The bumpers 42 on the outer side rail 18 of the gate section 10, as stated above, are movable between extended and retracted positions, and their construction and the system for moving them is shown in detail in FIGS. 8–10. As shown in FIG. 9A, the rail includes an outside wall 70, a front wall 72, and an inside wall 74 that together define a rearwardly open channel 76. The outside wall 70 in turn carries a pair of U-shaped plunger guides 78 that extend away from the outer surface of wall 70. Each guide 78 provides a seat for a piston 80 having a body portion 82 and piston finger 84 in the form of a flange carried on the inner end of the body portion. The outer end of each piston has a bumper mount 86 that carries a bumper cap 88.

The bumper pistons 80 are moved between the extended and retracted positions by a drive member 87 which is mounted in the channel 76 of the vertical outer side rail 18. The drive member 87 is itself generally U-shaped in cross-section and is mounted for up and down vertical motion in the channel 76. The bottom wall 90 of the drive member 86 has a plurality of slots 92 through which screws 94 extend and engage the screw seats 97 molded into the channel 76 of outer side rail 18. The screws 94 and slots 92 retain the drive member 87 in the channel 76 but allow it to move vertically in the channel. The drive member 87 has a pair of cam members 96 that engage the piston fingers 84 on each side so as to move the pistons 80 between their extended and retracted positions as is described in greater detail below.

The drive member 87 carries a finger 98 at its upper end 100 that extends beyond the top of the channel 76 in the outer side rail 18 and engages a cam 102 formed on the inside of the handle 104.

A bracket 110 is formed at the junction of the outer side rail 18 and the top rail 14 of the gate section 10 as an integral part of the gate section (see FIG. 10). The bracket 110 includes a circular hub 112 which receives the shaft 114 of a handle 104 so that the handle pivots about the axis 111 of the hub 112. The cam 102, molded as an integral part of handle 104, engages the finger 98 of the drive member 87. The cam 102 has a surface 105 that increases in distance from the axis 111 in a counterclockwise direction as viewed in FIG. 8–10. The handle is movable through an arc of approximately 70° from the horizontal position shown in full lines in FIG. 10 to the position suggested by the broken lines in that figure (see also FIGS. 8 and 9). When the handle 104 is in the horizontal position, the end 120 of the cam 102 in the handle further away from the handle axis 111 engages finger 98 of drive member 87 so as to move the drive member in a downwardly direction. When the handle 104 is lifted to the elevated position suggested in broken lines in FIG. 10 and in full lines in FIG. 9, the other end 122 of the cam 102 engages the finger 102 and under the influence of a coil spring 124 disposed in the channel 76 of the rail 18 at the bottom of drive member 87, the drive member is elevated.

The up and down motion of the drive member as stated above causes the bumpers 42 to move between their extended and the retracted positions. As shown in detail in FIGS. 8 and 9, each cam member 96 on the drive member 87 has an inclined slot 126 that defines two cam surfaces 128 and 130. The inclined fingers 84 on the back of the bumper pistons are disposed in the slots 126 between the two cam surfaces 128 and 130. Consequently, as the drive member 87 moves downwardly in the channel 76 of the rail 18, the cam surface 128 on the upper side of slot 126 engages the piston finger 84 of the piston 80 causing the piston to be pushed out of the plunger guide 78 to the extended position as in FIG. 8. On the other hand, when the drive member 87 is elevated, the cam surface 130 on the lower side of slot 126 engages the piston finger 84 and withdraws the piston 80 into the bumper guide 78 as shown in FIG. 9.

The bumper pistons 80 are retained in position in the guides 78 by the rectangular plates 136 carried by the drive member 87 and which overlie the pistons. The plates 136 prevent the pistons from falling out of the guides which are open on the rear side of the gate shown in FIGS. 8–10.

The upper rail 14 of the gate section 10 has a contoured seat 140 for the handle 104. The seat 140 includes a slot 142 in the side wall 146, which receives a thumb actuated detent 148 carried on the free end 150 of the handle away from its pivotal mounting. When the handle 104 is moved to the horizontal position to extend bumpers 42, the detent 148 registers with and engages the margin of the slot 142 to prevent the handle 104 from being elevated and retract the bumpers. Thus, a child cannot remove the gate from an opening simply by pulling upwardly on the handle 104 so as to relieve the pressure on the bumpers 42. However, the detent 148 can be manipulated by an adult by means of the retraction button 152 carried by the handle 104 and which engages the detent 148. When the button is slid downwardly on its track 156 on handle 104, the detent 148 is withdrawn into the handle so as to enable the handle to be pivoted to the elevated position of FIG. 9. However, without withdrawing the detent 104 from its slot 142, the handle cannot be elevated to retract the bumpers 42.

Figure 10A:
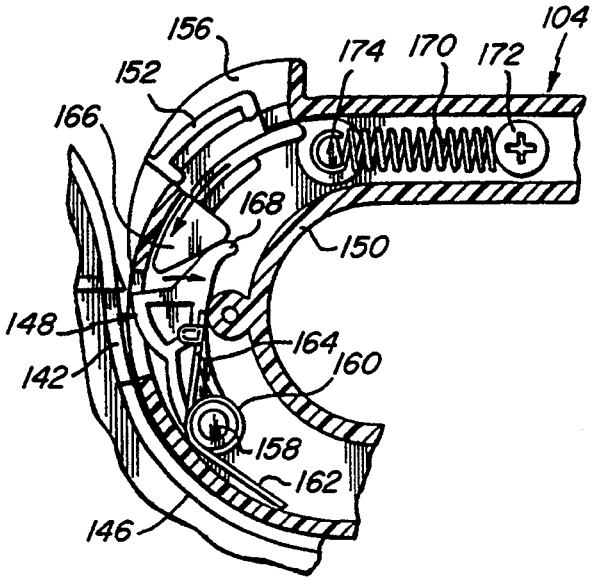
FIG. 10A is a detail view of the handle lock with the parts in the unlocked position.

The detent 148 and button 152 are shown in detail in FIG. 10A. The detent 148 is pivotally mounted on a post 158 in handle 104 and is urged in a counterclockwise direction as viewed in FIG. 10A by a coil spring 160 that has one end 162 which bears against the handle and a second end 164 which engages the detent. Under the action of spring 160, the detent extends out of the handle and into the slot 142 when the handle is in the lower, locking position.

The button 152, slidably mounted on its track 156, has a fin 166 that engages the free end 168 of detent 148. The button 152 is biased to a raised position on track 156 by a tension spring 170 connected between a post 172 in the handle and a second post 174 carried on the end of the button. When the button is moved downwardly on the track 156 toward the detent 148 against the bias of spring 170, the fin 166 bearing against the top 168 of the detent pivots it clockwise as viewed in FIG. 10A against the bias of spring 160 causing the detent to release the margin of slot 142 in the wall 146 of the handle seat. When the button 152 is released, spring 170 raises the button on its track and the fin 166 in turn releases the detent to the influence of spring 160 so that the detent returns to its latched position in slot 142.

To mount the gate in a doorway or other walkway in a home, the bumpers 42 and **42*a* alone may be used to hold the gate in place. This is particularly so when the doorway is defined by a substantial door frame with rigid, vertical sides. To do so the handle 104 is moved to the elevated position so as to retract the bumpers 42 on the gate section 10. The thumbscrews 38 and 40 on the front side of the gate are loosened and the gate is placed in the doorway and then extended by sliding the sections 10 and 12 so that the bumpers 42 and 42*a* on the outer side rails 18 and 28 engage the walls or doorframe or other structure which defines the walkway. With the gate expanded to the largest effective width in the walkway, the thumbscrews 38 and 40 are tightened to prevent the sections 10 and 12 from closing on one another and thereby reduce the effective width of the gate. Thereafter, with the gate in position in the walkway, the handle 104 is pivoted downwardly so as to cause the pistons 80 to extend outwardly from the outer side rail 18 of gate section 10, and by that action all four bumpers 42 and 42*a* are very firmly pressed against the walls, door frame or other structure. The handle detent 148 engages the slot 142 in the handle seat 140, and the extendable bumpers 42 are locked in the extended position. Mounted in that fashion, the friction between the four bumpers and walls render the gate capable of resisting very substantial forces applied to it without dislodging from the walkway. To remove the gate, the user need only lift the handle by pressing the finger button 152 downwardly on the track 156 on the handle so as to withdraw the detent 148 from the slot 142. By elevating the handle, the extendable bumpers 42** are retracted to relieve the pressure on the bumpers, and the gate may be removed.

Figure 15:
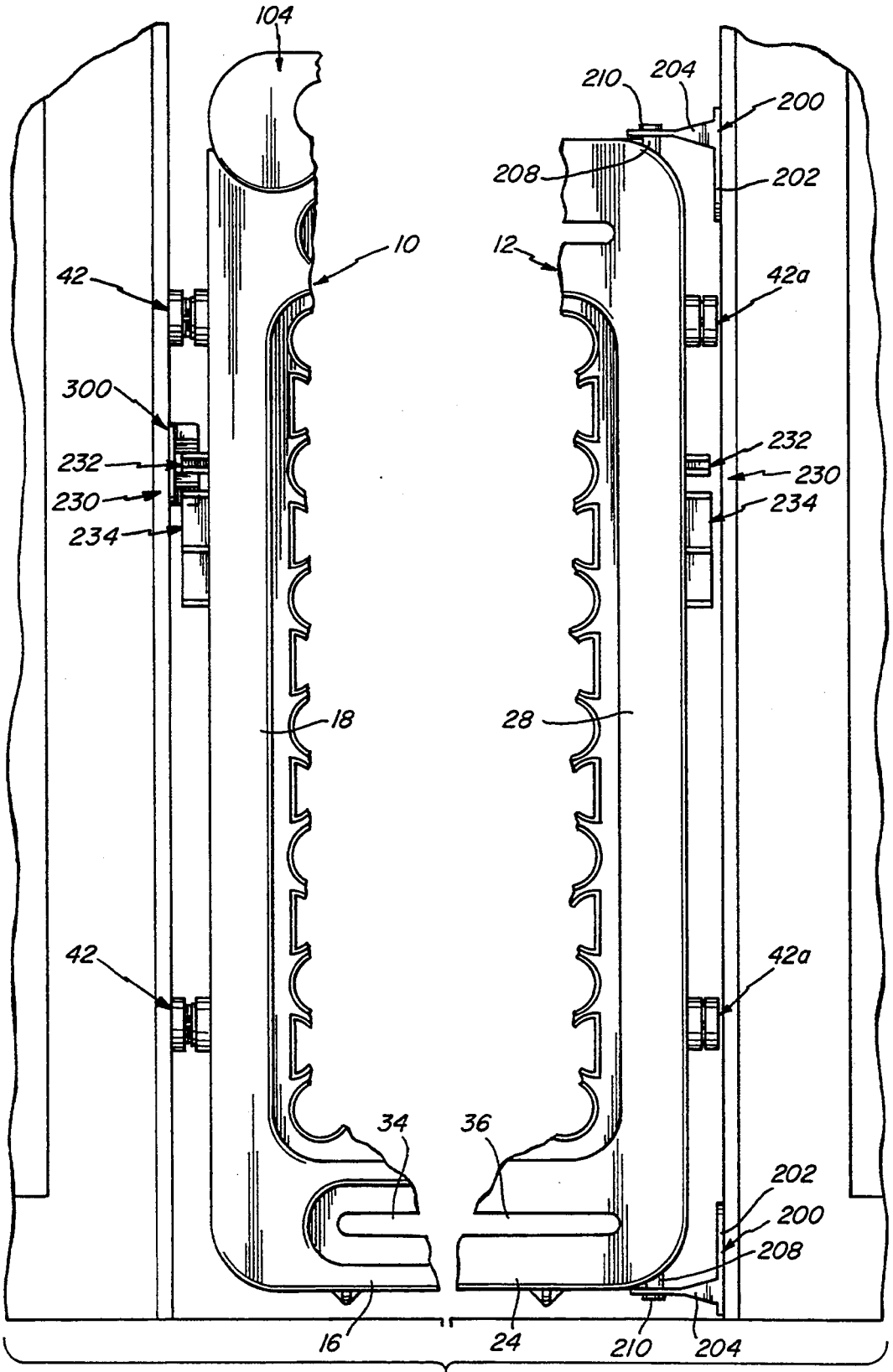
FIG. 15 is a fragmentary side elevational view showing the gate of this invention permanently mounted by means of a hinge in a doorway and employing a different type of bracket assembly than is shown in FIGS. 12–14 for positioning the gate.
Figure 16:
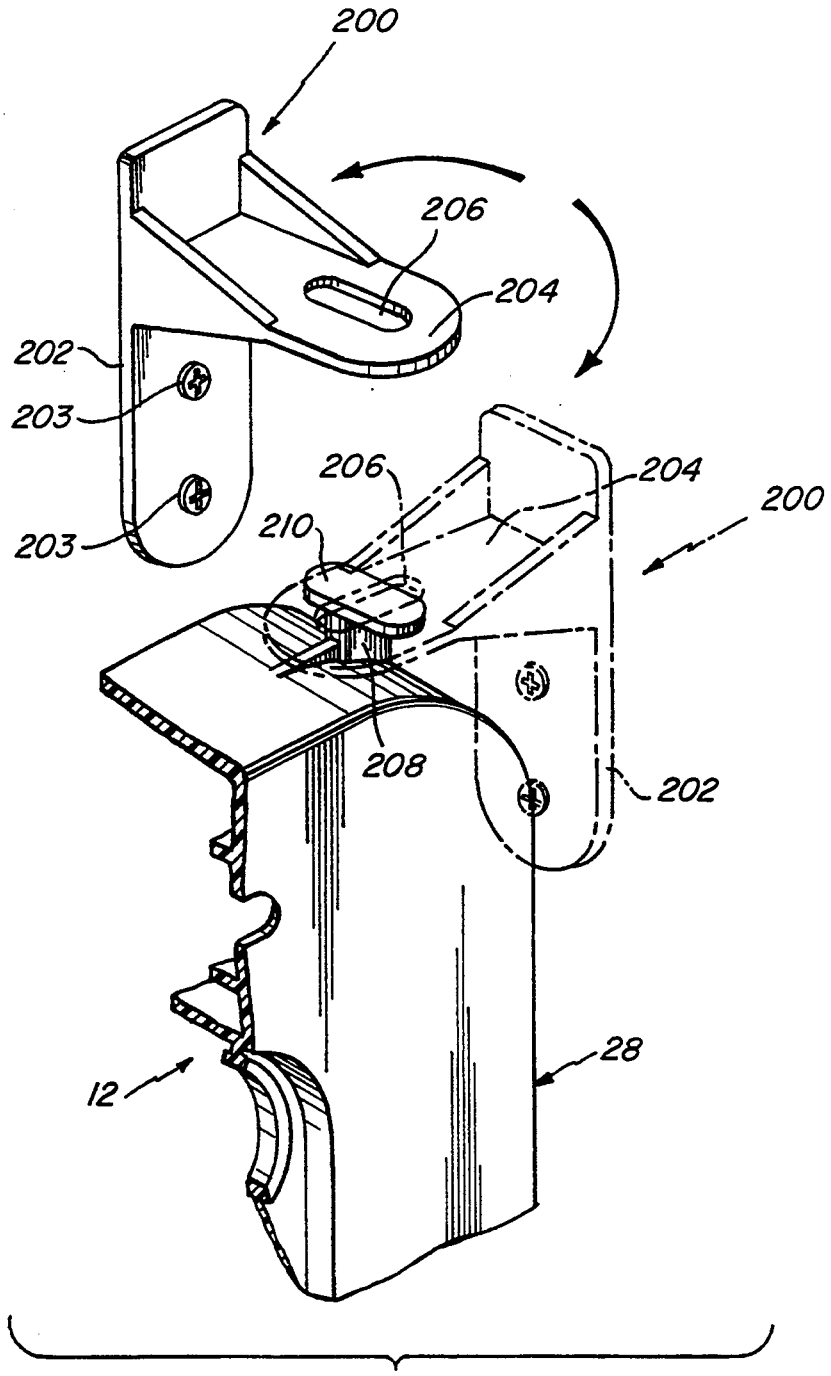
FIG. 16 is an exploded fragmentary perspective view of one hinge supporting the right side of the gate shown in FIG. 15.

The gate may also be pivotally mounted in a doorway by means of a pair of hinge brackets 200, one of which is shown in FIGS. 15 and 16. The bracket 200 is generally L-shaped and includes a vertical plate 202 that may be screwed to the doorframe. Holes 204 are provided in the plate 202 for that purpose. The hinge bracket 200 also includes a horizontal flange 204 having a slot 206 that receives a hinge pin 208 molded as an integral part of the gate section 12 on the top and bottom rails 22 and 24. The slot 206 in the flange 204 is elongated in a direction parallel to the plane of the door opening when the bracket 200 is mounted in place while each of the hinge pins 208 on the gate section 12 has a head 210 which is elongated perpendicular to the plane of the gate. Therefore, to mount the gate on the hinge brackets 200, the gate is oriented generally perpendicular to the plane of the door opening so as to align the heads 210 of the hinge pins 208 with the slots 206. This is suggested by the relationship of the gate and bracket shown in full lines in FIG. 16. Once the pins are inserted through the slots, the gate may be swung horizontally on the hinge brackets 200 through an arc of approximately 90° as suggested by the gate and broken line showing of the bracket in FIG. 16, either into or out of the doorway. To lock the gate in the closed position by means of the extendable bumpers 42, the gate is oriented in the plane of the doorway, and the width of the gate is extended so that the bumpers 42 just engage the doorway frame, and the thumbscrews 38 are thereafter tightened. The gate need not again be adjusted by varying the relationship of the sections 10 and 12 so long as it remains in the same doorway. The gate may be locked by means of the handle 104 in the manner described in detail above. In the embodiment of the invention described above employing the hinge, the gate is held in place by pressure exerted by the bumpers 42 against the sides of the doorway. The bumpers **42*a*** do not engage the door frame (see FIG. 15), but rather the pins 210 bear against the ends of the slots 206 nearer the plates 202.

In certain locations where the gate may be used, such as openings in iron railings, the surfaces defining the opening may not be large enough or solid enough to provide a firm grip between the bumpers of the gate and the side of the opening, such as ends of the railing. In the following embodiments, special mounting brackets are provided which both aid in positioning the gate in an opening and supplement the action of the bumpers to retain the gate in the opening. On the vertical outer side rails 18 and 28 of the gate sections 10 and 12, respectively, fixed bracket assemblies 230 are molded as an integral part of the rails and are adapted to cooperate with separate brackets mounted on the sides of the opening in which the gate is mounted, such as the end-posts of an iron railing, to secure the gate in place. The fixed bracket assemblies on the outer side rails 18 and 28 are shown in FIGS. 1-3, 10, 12-15, 17 and 18. The brackets on each of the two outside rails are identical to one another and, therefore, only one need be described.

The bracket assembly 230 is composed of an upper horizontal bracket 232 and a lower vertical bracket 234 molded as an integral part of the vertical outer side rail. The upper bracket 232 includes a pair of horizontal flanges 236 and 238 joined together at their center by a vertical flange 240. The horizontal flanges 236 and 238 may be somewhat enlarged at their centers where they are joined together by the vertical flange 240 so as to increase the overall stiffness of the bracket. The flanges are essentially the full width of the outside wall 54 or 70 of the rail on which they are formed and typically may be 1⅜ inches in width and ½ inch in depth. The space between the flanges may be approximately ⅛ inch, and if the thickness of the horizontal flanges is tapered, the space between them may be approximately ⅛ inch at the ends and narrow to approximately 3/32 of an inch adjacent the vertical flange 240.

The lower bracket 234 includes a vertical flange 242 approximately 2¼ inches long and of the same depth as the horizontal flanges 236 and 238 of the upper bracket 232. The vertical flange 242 is stiffened by three ribs 244, 246 and 248 which respectively engage the vertical flange 242 at the top, bottom and center. The lower rib 246 is tapered downwardly slightly to provide a lead-in angle when the lower bracket 234 is used to support the gate in place (see FIGS. 12 and 14).

Figure 13:
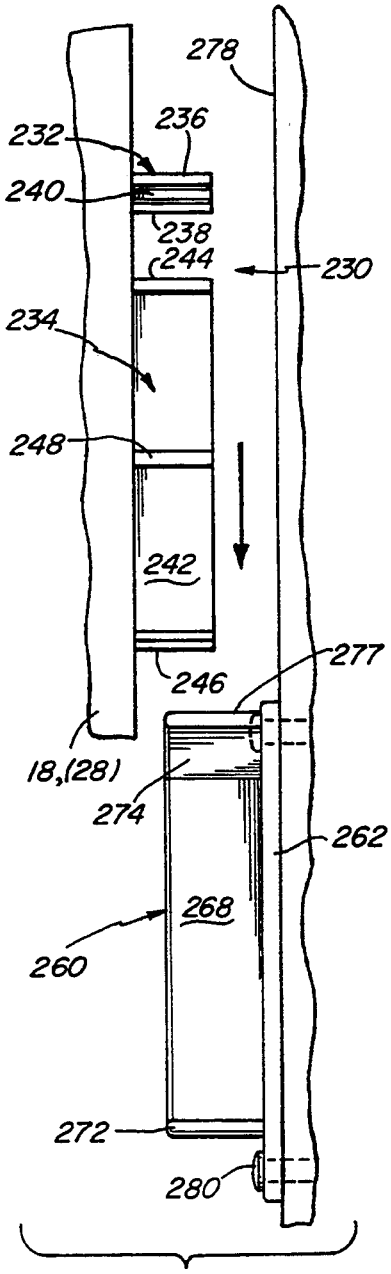
FIGS. 13 and 14 are side and front views of the assembly shown in FIG. 12 and further showing the manner in which the gate is supported in position in the doorway by means of the bracket assembly.
Figure 12:
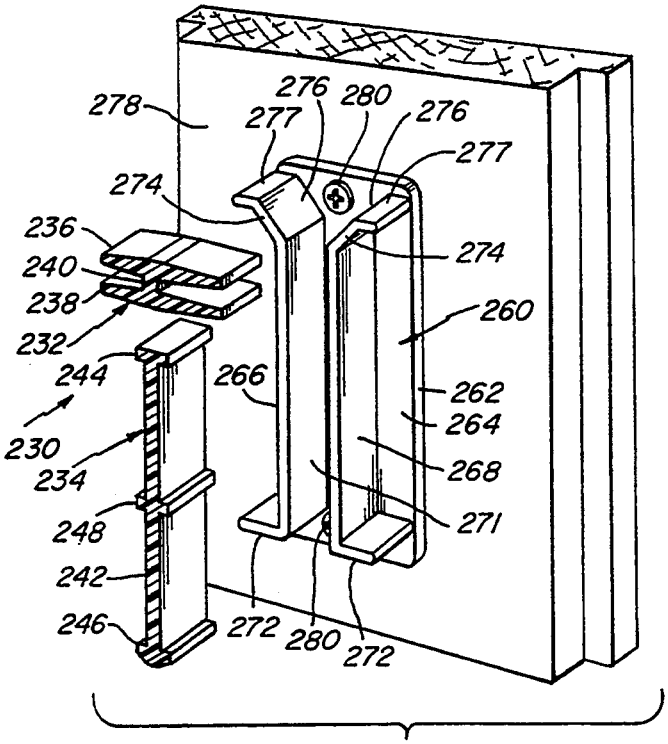
FIG. 12 is an exploded perspective view of one embodiment of a mounting bracket assembly for positioning the gate in a doorway.
Figure 14:
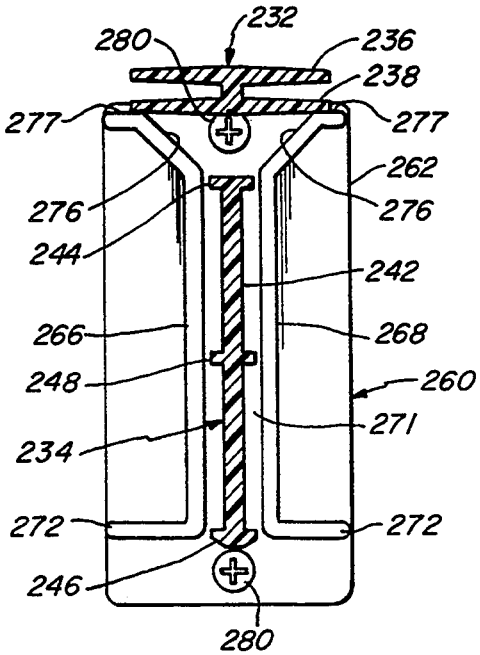

In FIGS. 12-14, one form of bracket 260 is shown which cooperates with the fixed bracket assembly 230 on the gate. The bracket 260 is to be used when the gate is to be removed entirely from the passageway when not in use. A bracket like that shown in FIGS. 12-14 will be used on each side of the opening, one to cooperate with the bracket assembly 230 on each outer side rail of the gate. The bracket 260 includes a vertical mounting plate 262 on the outer face 264 of which are a pair of flanges 266 and 268 that are mirror images of one another. The flanges 266 and 268 throughout most of their length are parallel to one another. The space 271 between the flanges 266 and 268 receives the bracket 234 on the opposed vertical side rail of the gate. Stiffening ribs 272 extend horizontally from the bottoms of the respective vertical flanges 266 and 268, and upwardly diverging ribs 274 are connected to the upper ends of the flanges. The ribs 274 have upwardly diverging surfaces 276 that define a lead-in angle to the space 271 for the rib 246 and lower end of the vertical flange 242 in bracket 234 on the gate.

The bracket 260 may be mounted on a door frame, railing or wall describing the passageway, in any one of several different ways. For example, in FIG. 12 the bracket 260 is shown mounted on the surface 278 of the frame by means of screws 280. The holes for the screws may be preformed in the plate 262. Alternatively, the plate 262 may be attached to the surface 278 by cement or other adhesive either applied as a liquid to the rear surface of the plate 262 and/or the exposed surface 278 of the doorway frame or by a pressure sensitive adhesive strip attached to either of those opposed surfaces.

The bracket 260 typically may be used within a wood framed passageway, or on the walls of an archway without a frame, joining two spaces in a home such as a hall and livingroom, or on the end posts of an opening formed by an iron railing to complement the holding force provided by the bumpers 42 and 42*a* against the sides of the passageway or other opening. When the brackets 260 are to be used, they are mounted on the margins of the passageway by any one of the known techniques recited above and are positioned at a height to correspond to the height of the mounting brackets 234 on the outside rails of the gate when the gate is held at the normal position within the passageway. To identify the correct height for the brackets 260 on each side of the gate, the bumpers may temporarily be used to support the gate in the desired position. When the brackets 260 are secured in place, the gate is simply lowered in the plane of the passageway so that the mounting brackets 234 on the outer side rails slip into the space 271 between the vertical flanges 266 and 268 in the bracket 260 until the upper bracket 232 rests on top of the horizontal portions 277 of the ribs 274. This action is illustrated in FIGS. 13 and 14. In FIG. 13, the mounting bracket 234 on the outer side rail is shown aligned with the top of the opening 271 between the vertical flanges 266 and 268 of bracket 260, and in FIG. 14 the gate is shown lowered so that the bracket section 234 is disposed between the flanges 266 and 268 and the upper horizontal bracket 232 rests on the upper surfaces 277 of the ribs 274. Duplicate brackets are disposed on both sides of the gate. After the gate is mounted in that fashion in the brackets 260, the gate is securely anchored by means of the bumpers 42 and 42*a*. That is, the handle which is elevated as the gate is mounted in the brackets 260 is then pivoted to the locking position shown in FIG. 8 so as to extend the bumpers 42 causing all of the bumpers to be pressed firmly against the sides of the doorway.

Figure 17:
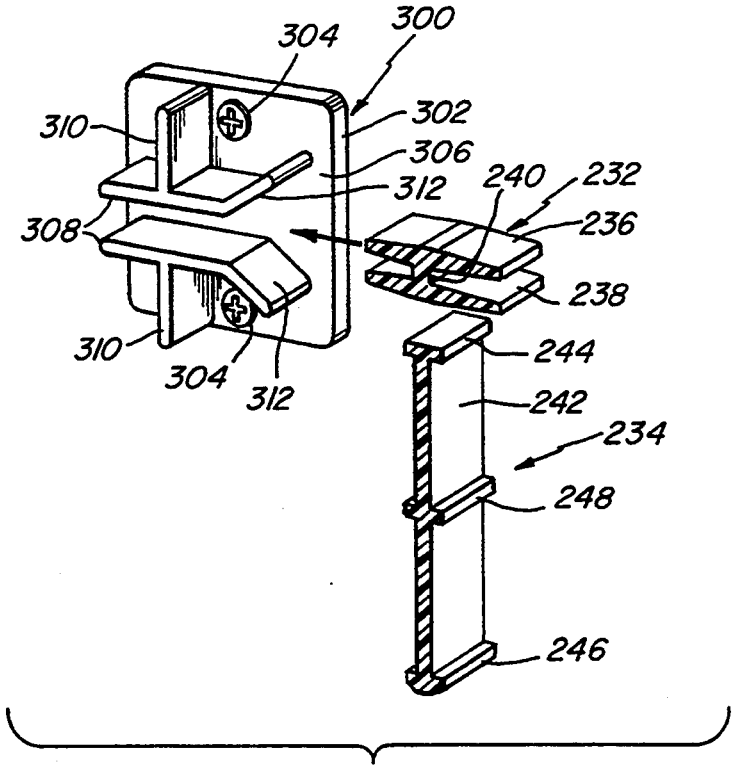
FIG. 17 is an exploded fragmentary perspective view showing details of the bracket assembly employed on the left side of the gate in the arrangement of FIG. 15.
Figure 18:
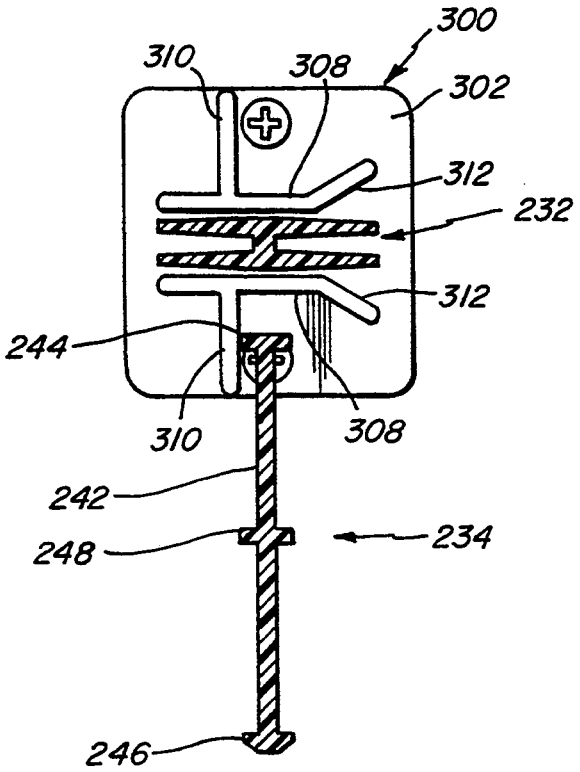
FIG. 18 is a fragmentary elevation view showing the bracket assembly of FIG. 17 engaged so that the gate is in the closed position.

In FIGS. 17 and 18, a different bracket arrangement is shown, which cooperates with the mounting bracket on the outer side rail 18 when the gate is permanently installed by means of a hinge in a doorway as shown in FIG. 15. In this arrangement, a mounting bracket 300 is employed having a mounting plate 302 which may be secured to the margin of a doorway by means of screws, adhesive, or other means, just as the bracket 260 shown in FIGS. 12-14. Holes 304 are provided in the mounting plate to facilitate the use of screws to mount the bracket 300 in the opening. The front face 306 of mounting plate 302 carries a pair of horizontal, spaced apart flanges 308 that are stiffened by means of vertical ribs 310. The right end of the flanges 308 as viewed in FIGS. 17 and 18 diverge from one another as shown at 312 to assist in guiding the bracket 232 on the outer side rail 18 between the flanges 308. The upper bracket section 232 carried by the outer side rail 18 enters between the flanges 308 in bracket 300 as the gate swings into the plane of the door opening to the closed position, assuming of course that the bracket 300 has been mounted at the proper height. When the upper bracket section 232 is disposed within the space between the flanges 308, the lower bracket 234 on the gate outer side rail 18 engages the lower of the ribs 310 so as to prevent the gate from swinging beyond the closed position. This is clearly illustrated in FIG. 18. When the gate is in the closed position with the mounting bracket assembly 230 composed of brackets 232 and 234 engaging the bracket 300 on the side of the passageway, the handle 104 may be locked in the down position to extend the bumpers 42 against the side in the same manner as described above. It will be appreciated that because of the symmetry of the brackets 232, 234 and 300, the bracket 300 may be reversed from the position of FIG. 17 to allow the gate to swing open in an opposite direction.

Having described this invention in detail, those skilled in the art will appreciate that the gate of this invention has many advantages. For example, the gate may very easily be repeatedly mounted in place or removed from a passageway once its effective width is adjusted for a particular door opening merely by using the handle 104 which extends and retracts the movable bumpers 42. Because typically a gate is repeatedly used in the same doorway or passageway, once the effective width of the gate is set by means of the convenient thumb screws 38 and 40, the gate may very easily be mounted and dismounted by operating the handle 104. When additional support for the gate is desired, the various brackets 260 and 300 shown in FIGS. 12–14, 17 and 18 may be used in cooperation with the mounting bracket assembly or assemblies 230 formed on the outer siderails 18 and 28. In all uses, however, the bumpers provide the major holding force for the gates. The brackets 260 and 300, however, compliment the holding force of the bumpers, and establish the appropriate position for the gate to insure that the bumpers will engage the appropriate areas of the side of the doorway or railing.

Having described the invention in detail, those skilled in the art will appreciate that numerous modifications may be made of this invention without departing from its spirit. Therefore, it is not intended that the breadth of this invention be limited to the specific embodiments illustrated and described. Rather, the breadth of the invention is to be determined by the appended claims and their equivalents.

What is claimed is:

1. An adjustable width safety gate for children for closing a doorway or railing opening comprising a pair of gate sections each having top and bottom rails and slidably attached together at their top and bottom rails so that their effective combined width can be varied to fill the width of doorways or railing openings of different widths, each of said pair of gate sections also having inner and outer generally vertical side rails, a movable bumper mounted on one of the outer side rails and movable between extended and retracted positions, a second bumper mounted on the other of the outer side rails, said bumpers on the outer side rails being adapted to bear against and frictionally engage the opposite sides of a doorway or rail opening when the movable bumper is moved to its extended position, a drive assembly movable vertically on the outer side rail carrying the movable bumper for moving it between extended and retracted positions, and a handle mounted on the top rail of the gate section having the movable bumper and connected to the drive assembly for raising and lowering said assembly enabling a user to operate the drive assembly to move the movable bumper between extended and retracted positions.

2. An adjustable width safety gate as defined in claim 1 wherein the movable bumper includes a piston movable horizontally on its outer side rail, interengaging cams on the drive assembly and piston causing the vertical movement of the drive assembly to horizontally move the bumper, said handle being movable between two positions to extend and retract the movable bumper.

3. An adjustable width safety gate as defined in claim 1 wherein first and second brackets are carried one each by the outer side rails of the two sections and third and fourth brackets are adapted to be mounted on opposite sides of the doorway or rail opening, said first and second brackets mechanically interlocking with the third and fourth brackets for preventing the gate from being forced out from between the sides of the doorway or rail opening by a force that would overcome the frictional engagement of the bumpers with the side of said opening.

4. An adjustable width safety gate as defined in claim 1 wherein a hinge is connected to the outer side rail of said one of said gate sections and a first bracket is mounted on the outer side rail of the other of the gate sections, said hinge adapted to be attached to one side of the opening to enable the gate to pivot from between the sides of the opening when the bumpers on the other section are retracted, and a mating bracket adapted to be mounted on the side of the opening to be engaged by the movable bumper on the outer side rail of the other section, said brackets preventing the gate from being forced out from between the sides of the opening by a force that would overcome the frictional engagement of the movable bumper with the side of the opening engaged by them.

5. An adjustable width safety gate as defined in claim 1 wherein the attachment between top and bottom rails of the two sections includes slots in the top and bottom rails of at least one section and fasteners extending through the slots and engaging the both sections, said fasteners being manually tightened and loosened so as to enable the sections to slide away and toward one another to vary the effective width of the gate and to releasably lock the sections in fixed positions with respect to one another.

6. An adjustable width safety gate as defined in claim 5 wherein first and second brackets are carried one each by the outer side rails of the two sections, third and fourth brackets adapted to be mounted on opposite sides of the passageway or rail opening, said first and second brackets mechanically interlocking with the third and fourth brackets for preventing the gate from being forced out from between the sides of the passageway or rail opening by a force that would overcome the frictional engagement of the bumpers with the sides of said passageway or opening.

7. An adjustable width safety gate as defined in claim 5 wherein a hinge is connected to the outer side rail carrying the second bumper and a first bracket is mounted on the side rail carrying the movable bumper, said hinge adapted to be attached to one side of the opening to enable the gate to pivot from between the sides of the opening when the movable bumper on the other section is retracted, and a mating bracket adapted to be mounted on the side of the opening to be engaged by the movable bumper, said brackets engaging one another and preventing the gate from being swung out of the opening by a force that would overcome the frictional engagement of the movable bumper with the side of the opening engaged by it.

8. An adjustable width safety gate as defined in claim 5 wherein the movable bumper includes a piston movable horizontally on its outer side rail, interengaging cams on the drive assembly and piston causing the vertical movement of the drive assembly to horizontally move the bumper, said handle being movable between two positions to extend and retract the movable bumper.

9. An adjustable width safety gate as defined in claim 8 wherein first and second brackets are carried one each by the outer side rails of the two sections and third and fourth brackets are adapted to be mounted on opposite sides of the passageway or rail opening, said first and second brackets mechanically interlocking with the third and fourth brackets for preventing the gate from being forced out from between the sides of the passageway or rail opening by a force that would overcome the frictional engagement of the bumpers with the sides of said passageway or opening.

10. An adjustable width safety gate as defined in claim 8 wherein a hinge is connected to the outer side rail carrying the second bumper and a first bracket is mounted on the side rail carrying the movable bumper, said hinge adapted to be attached to one side of the opening to enable the gate to pivot from between the sides of the opening when the movable bumper on the other section is retracted, and a mating bracket adapted to be mounted on the side of the opening to be engaged by the movable bumper, said brackets engaging one another and preventing the gate from being swung out of the opening by a force that would overcome the frictional engagement of the movable bumper with the side of the opening engaged by it.

11. A security gate for children adapted to be mounted in an opening such as a doorway or passageway comprising a frame including a pair of outer side rails, a top rail, and a bottom rail, a screen secured to the rails for preventing passage through the frame, at least one movable bumper mounted on and movable with respect to one of the side rails and movable between retracted and extended positions on its rail for bearing against and frictionally engaging one side of the opening in which the gate is mounted when the bumper is extended, an actuating mechanism including a handle mounted on the top rail of the frame and connected to the movable bumper for extending and retracting the movable bumper so that the gate may be mounted in and removed from the opening, means provided in the gate frame independent of the bumpers for positioning the gate in position within the opening, and the means includes a first bracket assembly mounted in the one outer side rail and a bracket for mounting on the one side of the opening and engaging the first bracket assembly.

12. A security gate as defined in claim 11 wherein the gate includes two sections that are extendable so as to enable the effective width of the gate to be changed so that the gate can be used in openings of different width.

13. A bracket assembly for supporting a gate in a doorway or an opening in a railing comprising a first bracket section to be mounted vertically on an end of a gate, a second bracket section to be mounted on the end of the gate above and in close proximity to the first bracket section, and a third bracket section to be mounted on the frame of a door or vertical end post of a railing, said third bracket section having a slot for receiving either the first or second bracket section and adapted to be engaged by the other of the first and second sections for orienting the gate carrying the first and second bracket sections with the doorway or opening in the railing.

14. A bracket assembly for supporting a gate in a doorway or an opening as defined in claim 13 wherein the slot in the third bracket section receives the first bracket section.

15. A bracket assembly for supporting a gate in a doorway or an opening as defined in claim 14 wherein the slot is vertical and the first section is lowered into the slot.

16. A bracket assembly for supporting a gate in a doorway or an opening as defined in claim 13 wherein the slot in the third bracket section receives the second bracket section.

17. A bracket assembly for supporting a gate in a doorway or an opening as defined in claim 16 wherein the slot is horizontal and the second bracket section moves horizontally into the slot.

* * * * *